US005236037A

United States Patent [19]

Watkins

[11] Patent Number: 5,236,037

[45] Date of Patent: Aug. 17, 1993

[54] UNITIZED WELLHEAD SYSTEM

[75] Inventor: Bruce J. Watkins, Houston, Tex.

[73] Assignee: Dril-Quip, Inc., Houston, Tex.

[21] Appl. No.: 817,291

[22] Filed: Jan. 6, 1992

[51] Int. Cl.[5] ..... E21B 33/047

[52] U.S. Cl. ..... 166/89; 166/97.5; 285/133.2; 285/134

[58] Field of Search ..... 166/97.5, 85, 88, 89, 166/368; 285/133.2, 140, 134

[56] References Cited

U.S. PATENT DOCUMENTS

| | | | |
|---|---|---|---|
| 4,214,778 | 7/1980 | Diehl | 166/89 X |
| 4,770,249 | 9/1988 | Courtney | 166/89 X |
| 5,092,401 | 3/1992 | Heynen | 166/89 |

FOREIGN PATENT DOCUMENTS 0422705 8/1990 European Pat. Off. .

OTHER PUBLICATIONS

Composite Catalog of Oilfield and Pipeline Equipment, 1986-87 Edition, pp. 721 and 1395.

*Primary Examiner*—William P. Neuder

*Attorney, Agent, or Firm*—Vaden, Eickenroht, Thompson, Boulware & Feather

[57] ABSTRACT

There is disclosed a unitized wellhead system wherein each of concentric well strings are suspended within a well bore by means of individual hanger mandrels installed within the bore of a single wellhead housing.

4 Claims, 3 Drawing Sheets

UNITIZED WELLHEAD SYSTEM

Figure 1:
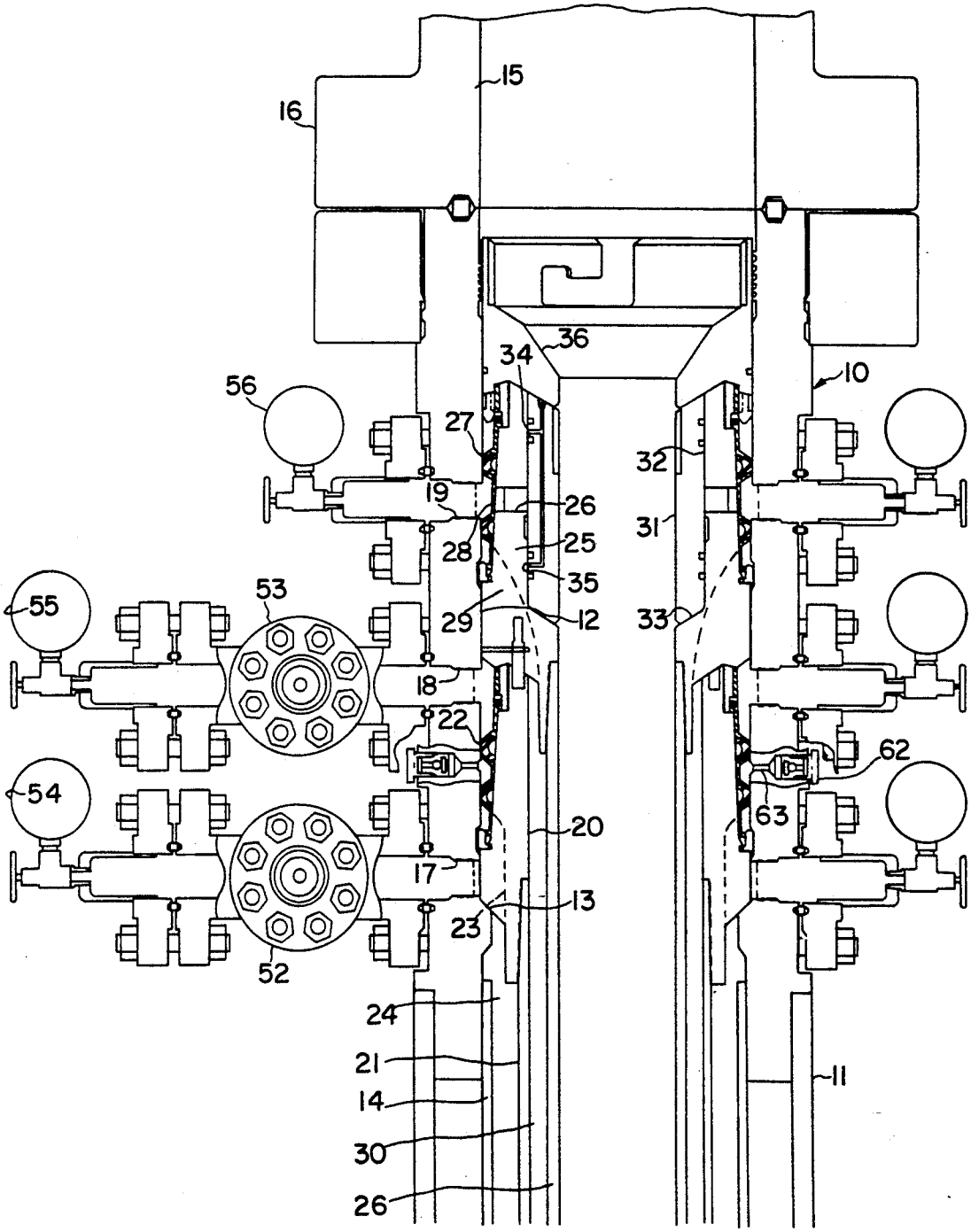

This invention relates generally to wellhead systems for use in the drilling and completion of oil and gas wells. More particularly, it relates to improvements in wellhead systems of the so called unitized type.

In a wellhead system commonly used prior to the unitized type, each of a plurality of concentrically arranged well strings was suspended from an individual spool or head of a series of vertically arranged heads. More particularly, a hanger connectible to the upper end of each well string was landed on a seat in an individual spool, and each spool had a side outlet connecting with the annular space between the casing suspended from the spool and an outer well string, such that the flow of well fluid in the spaces could be controlled by a valve connected to the side outlet. Among other things, this required that a blowout preventer be installed above each head, as a well string was run therethrough, and then removed to permit another head to be installed.

In systems of this unitized type, however each of a plurality of concentrically arranged well strings is suspended in a single wellhead housing mounted at the upper end of the well. Thus, a series of hanger mandrels are sequentially lowered through a blowout preventer at the upper end of the housing bore for landing above a seat about the bore to support progressively smaller strings of casing one within the other and a string of tubing within the innermost casing string. More particularly, means are provided for sealing between each hanger mandrel and the housing bore so as to fluidly connect the annulus between each string suspended therefrom and an outer string with one of vertically spaced side outlets from the housing bore above the seat.

Since its bore must be large enough to pass a bit for drilling the largest diameter hole of the well bore, as well as each such hanger, the wellhead housing is a major cost item in the use of such a system. More particularly, its cost is also dependent on the height of its bore, which, in prior systems of the unitized type, must be sufficient to receive the accumulative heights of all the hangers. That is, each such hanger has an outer diameter adapted to seal with respect to the bore in order to fluidly connect the annulus between its string and the string of a lower hanger with a side outlet from the bore. Thus, prior unitized systems don't permit the operator to add a casing string to the casing program, once drilling has begun, without initially requiring a larger wellhead housing. Also, the annulus formed by the additional string cannot be connected to a side outlet valve.

The primary object of this invention is to provide a unitized wellhead system which overcomes these shortcomings of prior systems of this type in that it permits the operator to add a string of casing to the program even though the bore of the wellhead housing was of a height designed to receive and suspend one less hanger.

Another object is to provide an improved system of the type described which provides the operator with this option without the added coat of a large number of alternatively usable parts.

Still another object is to provide such a system in which the hanger for suspending the tubing is of such construction as to permit its removal, should the need arise, through a blowout preventer having a smaller bore and thus of less cost to the operator.

These and other objects are accomplished, as shown in the illustrated embodiment of the invention, by a system which includes, as in prior unitized systems of this type, a wellhead housing have a bore therethrough with a seat about the bore and vertically spaced lower, intermediate and upper side outlets from the bore above the seat, a first hanger mandrel adapted to land in the housing bore above the seat for suspending a first casing therefrom, means for sealing between the first casing hanger mandrel and the bore of the housing between the intermediate and lower outlets so as to fluidly connect the lower outlet with the annulus between the first casing and an outer casing, and a second hanger mandrel adapted to land on the first hanger mandrel for suspending a second casing within the first casing.

However, in accordance with the novel aspects of the present invention, the second hanger has a seat about its bore and a side port connecting with its bore above its seat, and the intermediate outlet is fluidly connected with the annulus between the first and second casings, when the second casing is suspended from the second mandrel, by means which seals between the second hanger mandrel and the housing bore above and below the upper outlet from the housing as well as above and below the side port in the second mandrel. More particularly, a third hanger mandrel is adapted to land on the seat on the second mandrel so as to suspend tubing with the second casing, when the second casing is suspended from the second mandrel, and within the first casing, when the second casing is not suspended therefrom, and means are provided for sealing between third mandrel and second mandrel above the side port in the second mandrel so as to fluidly connect the port in the second mandrel and thus the upper outlet from the housing with the annulus between the tubing and the second casing, when the second casing is suspended from the second mandrel, and the annulus between the tubing and first casing, when the inner casing is not so suspended. Thus, the operator may elect, even after drilling has begun, to either run or not run the second casing, without the necessity of a wellhead housing having a bore of a height for sealing between it and the hanger from which the second casing is suspended.

The apparatus further includes first and second valves adapted to be connected to the housing in fluid communication with the lower and intermediate outlets, a third valve adapted to be connected to the housing in fluid communication with the upper housing outlet when the second casing is suspended from the second hanger, and means adapted to be connected to the housing to close the upper housing outlet when the second casing is not suspended from the second hanger. Preferably, the housing also has additional upper, lower and intermediate side outlets to each of which pressure gauges may be connected.

In the preferred embodiment of the invention, a bore protector for landing on the seat in the second hanger is removable therefrom to permit landing of the third hanger thereon, and means are provided for sealing between the outer diameter of the bore protector and the bore of the second hanger above and below the side port in the second hanger.

Preferably, the apparatus also includes a fourth hanger mandrel adapted to land on the first hanger when the second hanger mandrel is not to be landed thereon for suspending a second casing therefrom, such fourth mandrel also having a seat about its bore and a side port above the seat, whereby said third hanger may be landed thereon and said third mentioned sealing means may be positioned to seal between said second and fourth mandrels above and below the port in the second mandrel so as to close the upper end of the annulus between the tubing and first casing. Thus, the fourth hanger enables the first casing to be suspended in a less expensive manner since it need not prepared for suspending the second casing.

Figure 2:
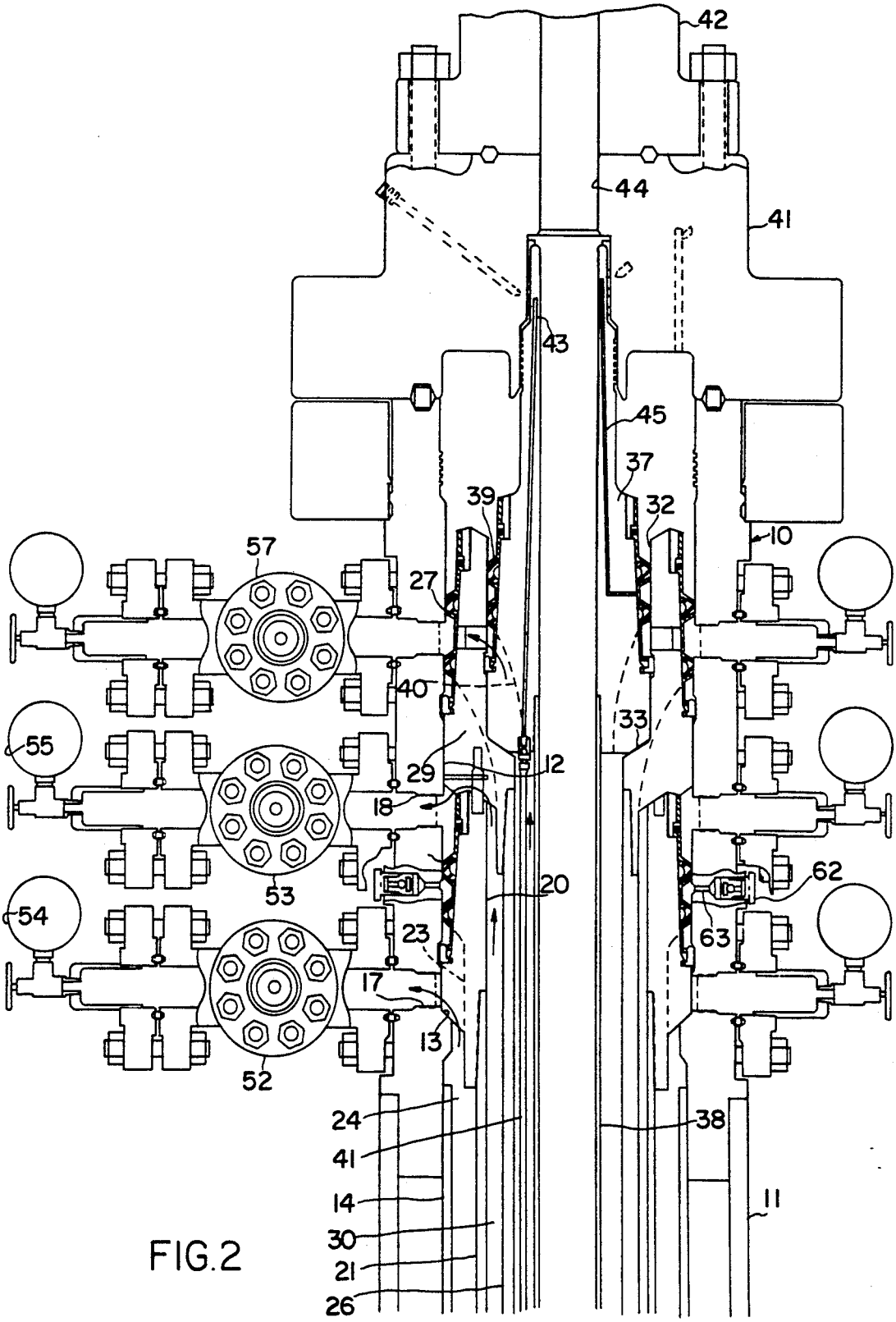
Figure 3:
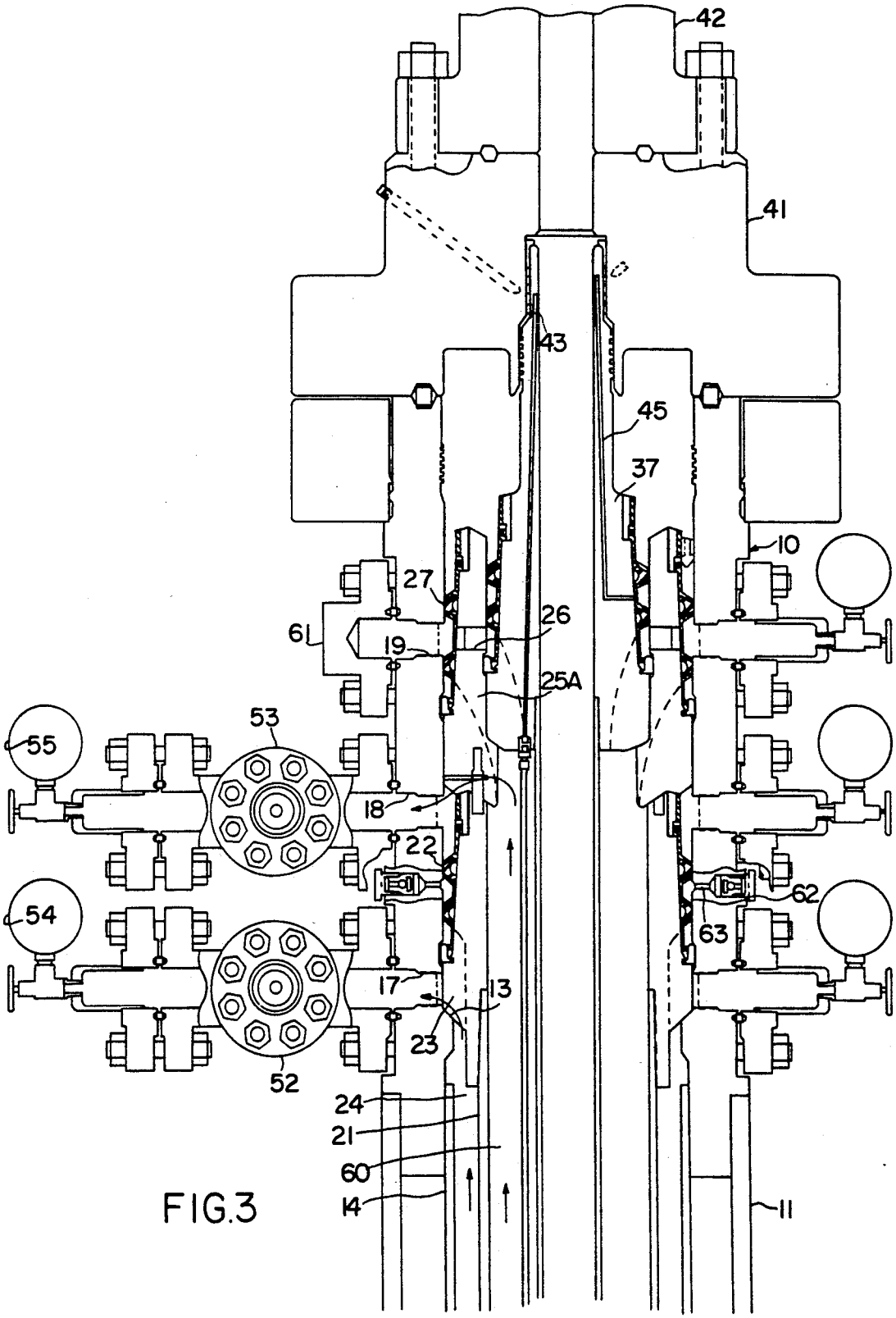

In the drawings, wherein like reference characters are used throughout the designated like parts:

FIG. 1 is a vertical sectional view of a unitized wellhead system constructed in accordance with the present invention and showing a first hanger landed on a seat about the wellhead housing to suspend a first casing within outer casing to which the wellhead housing is connected, a second casing hanger mandrel landed on the first mandrel for suspending a second casing within the first casing, means sealing between the first hanger and the housing bore intermediate a lower and an intermediate side outlet from the housing bore and between the second hanger and housing bore above and below an upper side outlet from the housing as well as above and below a side port in the second hanger, and a bore protector landed on a seat about the bore of the second hanger for closing the side port;

FIG. 2 is a vertical sectional view similar to FIG. 1, upon removal of the bore protector from within the bore of the second mandrel and landing of a third hanger mandrel on the seat about the bore of the second mandrel for suspending a tubing within the second casing, and means sealing between the second and third mandrels above the side port in the second mandrel so as to connect the upper side outlet from the housing with the annulus between the tubing and inner casing, and with the blowout preventer above the wellhead housing and replaced by a adapter having its bore sealably engaged about the upper end of the tubing; and FIG. 3 is a view similar to FIG. 2, but showing a fourth hanger mandrel installed in the place of the second hanger mandrel of FIGS. 1 and 2, and the third tubing hanger mandrel landed on a seat about the bore of the fourth mandrel, together with means sealing between the fourth hanger mandrel and the bore of the housing above and below the upper side outlet from the housing as well as above and below a side port in the bore of the fourth hanger mandrel, and between the tubing hanger and the fourth mandrel above the side port in the fourth mandrel, the fourth mandrel differing, however, from the second mandrel in that it has no thread preparation at its lower end for suspending a second casing within the first casing such that the upper side outlet from the housing bore is instead connected with the annulus between the tubing and first casing.

With reference now to the details of the above-described drawings, the wellhead assembly is shown in each of the FIGS. 1 to 3 as comprising a wellhead housing 10 installed at the upper end of a conductor casing 11 which has been cemented within the wellbore for lining same, the housing having a bore 12 therethrough and a seat 13 about the lower end of the bore. An outer casing 14 is connected to the lower end of the housing bore for suspension within the conductor casing 11 and the wellbore beneath the lower end of the conductor casing.

The upper end of the bore 12 of the wellhead housing forms a lower continuation of the bore 15 through a blowout preventer stack 16 installed above the wellhead housing to permit the well strings casing and hangers to be described to follow to be lowered therethrough under pressure controlled conditions. The housing also has lower, intermediate and upper side outlets 17, 18 and 19 respectively, from its bore at vertically spaced apart locations therein. As shown, there is a second group of such side outlets from the right hand side of the wellhead housing bore.

As shown in FIGS. 1, 2 and 3, a first hanger mandrel 20 has been lowered through the preventer bore 15 as well as the housing bore 12 to a position in which it lands upon the seat 13 so as to suspend a first casing 21 connected to its lower end within the outer casing 14. A seal assembly 22 is installed between the first hanger mandrel and the bore of the wellhead housing between the lower side outlet 17 and intermediate side outlet 18 from the bore so as to close off the upper end of the annular space between the mandrel and bore, and passageways 23 are formed about the outer side of the mandrel 20 so as to connect the annular space 24 between the casings 14 and 21 with the side outlet 17. The seal assembly is preferably of a type shown and described in U.S. Pat. No. 4,757,860, assigned to the assignee of the present application, and may be lowered into place between the hanger and housing after landing of the hanger.

A second tubing hanger mandrel 25 is also shown in FIGS. 1 and 2 to be landed in the housing bore on the upper end of the hanger mandrel 20 so as to suspend a second casing string 26 connected to its lower end within the first casing 21. Like the first casing, the lower end of the casing 26 is adapted to be cemented within the wellbore beneath the casing 21.

The hanger mandrel 25 has a pair of side ports 26 therein each connecting its bore with its outer diameter generally opposite an intermediate outlet 18, and a seal assembly having upper and lower seal rings 27 is installed within the annular space between the second hanger mandrel and the bore of the wellhead housing to close off the space above and below the ports 26 as well as above and below the upper side outlet 19. More particularly, the seal assembly 27 is similar to the seal assembly 22, except that ports 28 are formed through its outer wall intermediate the upper and lower seal rings so as to fluidly connect the ports 26 and the side outlets 19.

Passageways 29 are formed about the outer side of the hanger mandrel 25 so as to fluidly connect side outlets 18 with the annular space 30 between the first and second casings. More particularly, the upper end of this space is closed by the lower seal ring 27 of the seal assembly so as to fluidly connect the space 30 with the intermediate side ports 28.

As also shown in FIGS. 1 and 2, a tubular bore protector 31 is installed within the bore 32 of the second hanger 25 and supported at its lower end on a seat 33 about the bore. As shown, the bore through the bore protector 31 forms an upward continuation of the bore through the lower end of tubing hanger 25, and protects the sealing surfaces of the bore 32 in the second hanger as drilling proceeds through the second casing string 26.

Also, a bushing 36 is landed on the upper end of the second hanger and bore protector 31 to protect their upper ends during continued drilling. More particularly, upper and lower seals 34 and 35 carried about the outer diameter of the bore protector for sealing with the bore 32 of the second hanger above and below side ports 26. Thus, the bore protector not only protects the sealing surfaces of the bore 32 during further drilling, but also closes the inner end of the side ports 26 and thus the side outlets 19.

Upon drilling through the casing string 26, the wear bushing 36 and bore protector 31 are removed upwardly through the bore of the wellhead housing and bore 15 of the blowout preventer thereabove. At this time, a third hanger mandrel 37 is lowered through the preventer and into the bore of the wellhead housing for landing on the seat 33 about the bore on the second mandrel so as to suspend a tubing string 38 connected to its lower end within the second casing 26. More particularly, a seal assembly 39 is installed between the third hanger and the bore 32 through the second hanger for closing the annular space above the side ports 26, and passageways 40 are formed about the outer side of the mandrel 37 so as to connect the annular space 41 between the tubing and the second casing with the ports 26 and thus the upper side outlets 19.

As also shown in FIG. 2, the blowout preventer 16 has been removed from above the wellhead housing and replaced by an adapter 41 to the upper end of which a master valve 42 of a Christmas tree is connected. More particularly, a counterbore 43 in the lower end of the bore 44 through the adapter 41 is sealably engaged about the upper end 45 of tubing hanger mandrel, thus providing a flow path for production fluid upwardly through the tubing and the tubing hanger into the Christmas tree above the wellhead housing.

Valves 52 and 53 are connected to the sides of the wellhead housing to fluidly communicate with the lower and intermediate side outlets 17 and 18 from the bore of the wellhead housing. As well known in the art, these valves of course provide a means for controlling flow from the annular spaces 24 and 30 respectively. Pressure gages 54 and 55 are shown to be connected to the outer ends of the valve, again for well known purposes.

At the stage of the drilling procedure illustrated in FIG. 1, a pressure gage 56 is also connected in fluid communication with the upper side outlets 19 from the wellhead housing. Thus, at this stage, the operator does not necessarily know that he will install a second casing within the first casing and thus whether a further valve will need to be installed in fluid connection with the upper side outlet to control flow from the annular space between the tubing and the second casing string. However, when that decision has been made, the left hand pressure gage 56 is replaced by another flow control valve 57 similar to the valves 52 and 53 for fluid connection with the annular space 41 as shown in FIG. 2.

As previously mentioned, the wellhead system shown in FIG. 3 is similar to that of FIGS. 1 and 2 described above in connection with FIGS. 1 and 2, except that the second hanger mandrel 25 has been replaced by a fourth hanger mandrel 25 differing from the hanger mandrel 25A primarily in that it has no thread preparation at its lower end for suspending a second casing therefrom. Thus, hanger 25A may be installed when the operator does not wish to run a second casing mandrel in the first casing mandrel. Thus, in this case, flow through an annular space 60 between the tubing and the first casing connects with the intermediate side outlets 18 and thus the valve 53 intermediate seal assembly 22 and lower seal ring 27 For this purpose, the outer ends of the side outlets are closed by means of a blind flange 61 connected to the wellhead housing.

As previously described, tubing hanger mandrel 25A is similar in other respects to the hanger 25, thus having a bore 32 therethrough and a seat 33 at the lower end of the bore on which the tubing hanger 37 may be landed, and whereby a seal assembly 38 may be installed in the annular space between the tubing hanger mandrel and the bore of the mandrel 25A above the side port 26 in the mandrel hanger 25A.

The seal assemblies 22 and 27 may be tested in any suitable fashion. Thus, for example, plugs 62 having back pressure valves therein may be removably connected to side ports 68 in the housing to permit test fluid to be inserted into the annular space between the upper and lower seal rings of the seal assembly 22. The sealing engagement of the upper seal rings of the seal assembly 22 and lower seal ring of the seal assembly 27 may be tested by test fluid introduced through the side ports 18 by test plugs installed on valve 53. With the bore protector installed, the upper seal ring 27 may be tested externally from within the bore of the wellhead housing above it, while the sealing engagement of the inner sides of seal rings 27 may be tested by means of test fluid introduced between them through a suitable test plug connected with the upper side outlet 19.

The sealing engagement of seal rings 34 and 35 with the bore 32 may be tested through passageways formed in the bore protector and extending outwardly to the outer bore thereof intermediate the spaced apart pairs of such seal rings. Access to these passageways may be had from the upper end of the bore through the wellhead housing.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A unitized wellhead system, comprising a wellhead housing having a bore therethrough with a seat about the bore and vertically spaced upper, intermediate and lower side outlets from the bore above the seat, a first hanger mandrel adapted to land in the housing bore above the seat for suspending a first casing therefrom, means for sealing between the first casing hanger mandrel and the bore of the housing between the intermediate and lower outlets so as to fluidly connect the lower outlet with the annulus between the first casing and an outer casing, a second hanger mandrel adapted to land in the bore above the first hanger mandrel for suspending a second casing within the first casing and having a seat about its bore and a side port connecting with its bore above its seat, means for sealing between the second hanger mandrel and the housing bore above and below the upper outlet from the housing as well as above and below the side port in the second mandrel so as to fluidly connect the intermediate outlet with the annulus between the first and second casings, when the second casing is suspended from the second hanger mandrel, a third hanger mandrel adapted to land on the seat on the second mandrel so as to suspend tubing within the second casing, when the second casing is suspended from the second mandrel, and within the first casing, when the second casing is not suspended therefrom, and means for sealing between the third hanger mandrel and second hanger mandrel above the side port in the second hanger mandrel so as to fluidly connect the port in the second hanger mandrel and thus the upper outlet from the housing with the annulus between the tubing and the second casing, when the second casing is suspended from the second hanger mandrel, and the annulus between the tubing and first casing, when the inner casing is not so suspended.

2. As in claim 1, including first and second valves adapted to be connected to the housing in fluid communication with the lower and intermediate outlets, a third valve adapted to be connected to the housing in fluid communication with the upper housing outlet, when the second casing is suspended from the second hanger, and means adapted to be connected to the housing to close the upper housing outlet when the second casing is not suspended from the second hanger.

3. As in claim 2, wherein the housing has additional upper, lower and intermediate side outlets to each of which pressure gauges may be connected.

4. A unitized wellhead system, comprising a wellhead housing having a bore therethrough with a seat about the bore and vertically spaced upper, intermediate and lower side outlets from the bore above the seat, a first hanger mandrel adapted to land in the housing bore above the seat for suspending a first casing therefrom, means for sealing between the first casing hanger mandrel and the bore of the housing between the intermediate and lower outlets so as to fluidly connect the lower outlet with the annulus between the first casing and an outer casing, a second hanger mandrel adapted to land in the bore above the first hanger mandrel for suspending a second casing within the first casing and having a seat about its bore and a side port connecting with its bore above its seat, means for sealing between the second hanger mandrel and the housing bore above and below the upper outlet from the housing as well as above and below the side port in the second mandrel so as to fluidly connect the intermediate outlet with the annulus between the first and second casings, when the second casing is suspended from the second hanger mandrel, a bore protector adapted to land on the seat in the second hanger, means for sealing between the outer diameter of the bore protector and the bore of the second hanger above and below the side port in the second hanger, a third hanger mandrel adapted to land on the seat on the second mandrel, upon removal of the bore protector, so as to suspend tubing within the second casing, when the second casing is suspended from the second mandrel, and within the first casing, when the second casing is not suspended therefrom, and means for sealing between the third hanger mandrel and second hanger mandrel above the side port in the second hanger mandrel so as to fluidly connect the port in the second hanger mandrel and thus the upper outlet from the housing with the annulus between the tubing and the second casing, when the second casing is suspended from the second hanger mandrel, and the annulus between the tubing and first casing, when the inner casing is not so suspended.

* * * * *